US006338513B1

(12) United States Patent
Williams

(10) Patent No.: US 6,338,513 B1
(45) Date of Patent: Jan. 15, 2002

(54) MULTI-COMPONENT LIFTING ASSEMBLY FOR A CONTAINER

(75) Inventor: DeWayne B. Williams, Lafayette, IN (US)

(73) Assignee: Wabash Technology Corporation, Arlington Heights, IL (US)

( * ) Notice: Subject to any disclaimer, the term of this patent is extended or adjusted under 35 U.S.C. 154(b) by 0 days.

(21) Appl. No.: 09/545,725

(22) Filed: Apr. 8, 2000

(51) Int. Cl.[7] ..... B65D 90/00
(52) U.S. Cl. ..... 294/68.1; 220/1.5; 294/68.3
(58) Field of Search ..... 294/68.1, 68.3, 294/81.1, 81.5–81.56; 206/503, 509; 220/1.5

(56) References Cited

U.S. PATENT DOCUMENTS

| | | | | |
|---|---|---|---|---|
| 335,046 A | | 1/1886 | Springer | |
| 1,615,801 A | | 1/1927 | Elemendorf | |
| 2,256,375 A | | 9/1941 | Bonsall | |
| 2,963,310 A | * | 12/1960 | Abolins | 294/68.3 |
| 3,262,729 A | * | 7/1966 | Willison et al. | 294/68.3 |
| 4,904,017 A | | 2/1990 | Ehrlich | |
| 4,958,472 A | | 9/1990 | Ehrlich | |
| 5,072,845 A | * | 12/1991 | Grogan | 220/1.5 |
| 5,318,335 A | | 6/1994 | Erhlich | |
| 5,516,172 A | | 5/1996 | Ehrlich | |
| 5,573,293 A | * | 11/1996 | Baumann et al. | 294/68.1 |
| 5,678,715 A | * | 10/1997 | Sjostedt et al. | 220/1.5 |
| 5,782,519 A | * | 7/1998 | Baumann | 294/68.3 |
| 5,860,693 A | | 1/1999 | Ehrlich | |

* cited by examiner

*Primary Examiner*—Johnny D. Cherry
(74) *Attorney, Agent, or Firm*—Trexler, Bushnell, Giangiorg, Blackstone & Marr, Ltd.

(57) ABSTRACT

A multi-component lifting assembly is provided for a container which carries cargo. The container includes a floor, opposite side walls extending upwardly from the floor, and a roof sheet attached to upper ends of the side walls. The lifting assembly is attached to the walls and to the roof sheet such that four-point lifting stability is provided when the container is lifted by an overhead crane. The lifting assembly includes a stacking header which spans the width of the container, an inner cap which is provided on an interior of the container, and an outer cap which is provided on the exterior of the container. The roof sheet is sandwiched between the outer cap and the stacking header. The side wall is sandwiched between the outer cap and the inner cap. Aligned apertures are provided through the outer cap, the roof sheet, the stacking header and the inner cap such that a bayonet can be inserted therein and the container can be lifted. Aligned apertures are provided through the outer cap, the side wall, and the inner cap such that a side lifting pin can be inserted therein and the container can be lifted.

20 Claims, 7 Drawing Sheets

MULTI-COMPONENT LIFTING ASSEMBLY FOR A CONTAINER

BACKGROUND OF THE INVENTION

This invention is generally directed to a novel multi-component lifting assembly for a stackable and liftable container.

Conventional stackable and liftable containers have side walls formed from a plurality of metal plates joined together by vertical metal posts and have a "top pick point" at the junction between the roof and the side wall of the container approximately forty feet apart from each along each side wall of the container. The top pick points are paired in alignment across the roof and are secured to respective top rails of the container. This provides for four-point lifting stability when the container is lifted by an overhead crane.

A stacking frame is provided at these points. The stacking frame has aperture castings at the frame corners for connection during lifting and stacking. These castings are rectangular blocks with perpendicular edges. Typically, the castings and the frame protrude into the interior of the container and reduce the usable width and height on the interior of the container. Additionally, the stacking frame disrupts the roof of the container causing the roof to be installed in three sections. This results in four additional edges which are capable of leaking when raining. The corners of the roof sections are also subject to fatigue.

The multi-component lifting assembly of the present invention eliminates the stacking frame. This allows the roof to be installed in one piece and reduces the number of roof edges. As a result, initial installation costs and repair costs are reduced versus the prior art, and the possibility of leaking is reduced versus the prior art.

In addition, prior art lifting mechanisms were designed for top bayonet lifting or side lifting by pins, but not both. The present invention is designed to provide the ability to lift the container by top bayonet lifting and to lift the container by side lifting by pins in a convenient and easy manner.

Other features and advantages of the present invention will become apparent upon a reading of the attached specification in combination with a study of the drawings.

OBJECTS AND SUMMARY OF THE INVENTION

A general object of the present invention is to provide a novel multi-component lifting assembly for a stackable and liftable container.

An object of the present invention is to provide a novel multi-component lifting assembly for a stackable and liftable container which allows the roof of the container to be installed in one piece and reduces the number of roof edges.

Another object of the present invention is to provide a novel multi-component lifting assembly for a stackable and liftable container which is designed to provide the ability to lift the container by top bayonet lifting and to lift the container by side lifting by pins in a convenient and easy manner.

A further object of the present invention to provide a novel multi-component lifting assembly for a stackable and liftable container which has reduced initial installation costs and repair costs versus the prior art.

Yet a further object of the present invention is to provide a novel multi-component lifting assembly for a stackable and liftable container which reduces the possibility of leaking versus the prior art.

Briefly, and in accordance with the foregoing, the present invention discloses a multi-component lifting assembly for a container which carries cargo. The container includes a floor, opposite side walls extending upwardly from the floor, and a roof sheet attached to upper ends of the side walls. The lifting assembly is attached to the walls and to the roof sheet such that four-point lifting stability is provided when the container is lifted by an overhead crane. The lifting assembly includes a stacking header which spans the width of the container, an inner cap which is provided on an interior of the container, and an outer cap which is provided on the exterior of the container. The roof sheet is sandwiched between the outer cap and the stacking header. The side wall is sandwiched between the outer cap and the inner cap. Aligned apertures are provided through the outer cap, the roof sheet, the stacking header and the inner cap such that a bayonet can be inserted therein and the container can be lifted. Aligned apertures are provided through the outer cap, the side wall, and the inner cap such that a side lifting pin can be inserted therein and the container can be lifted.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
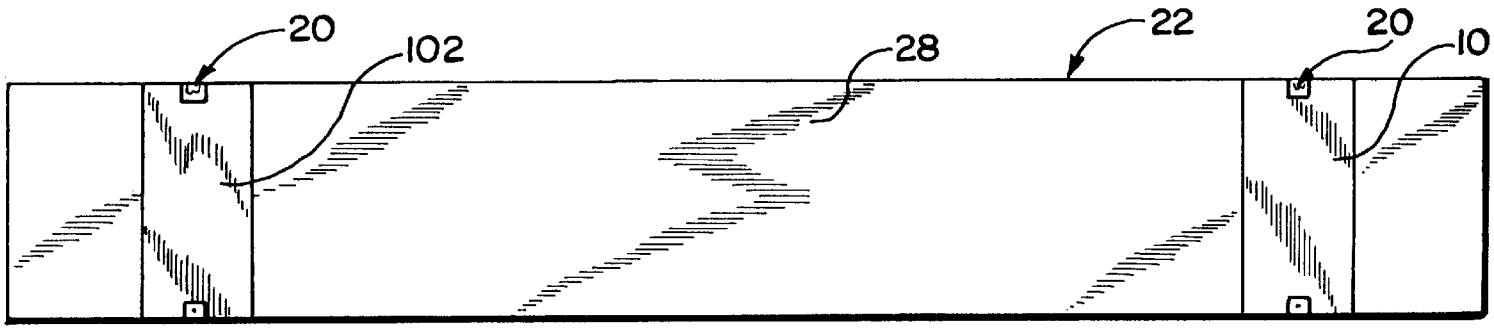
FIG. 1 is a side view of a container which incorporates the features of the invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

The present invention provides a novel multi-component lifting assembly 20 which is used on a stackable and liftable container 22. The container 22 includes a floor 24, a roof sheet 26, a front wall, a pair of opposite side walls 28 (only one of which is shown) and rear cargo doors. The container 22 is suitable for mounting on a conventional I-beam chassis trailer (not shown) which is towed by a conventional tractor (not shown). The container 22 of the present invention is greater than forty feet long, and is preferably fifty three feet long, and has a height of nine and a half feet.

Each side wall 28 of the container 22 may be formed from at least one metal plate, such as steel or aluminum, or may be formed from at least one composite plate, such composite plate being formed of thin metal skins with a plastic core sandwiched therebetween. If a plurality of plates are provided, the plates are fastened together by suitable means such as by rivets. Each plate in the side walls 28 is connected to a bottom rail 30 which is connected to the floor 24 and extends upwardly therefrom and is attached to a top rail 32 which is connected to the roof sheet 26, by suitable joining members, such as bolts or rivets. The top and bottom rails 30, 32 are conventional and are preferably extruded out of aluminum. If composite plates are used in the container 22, this provides the advantage that the resulting container 22 is lighter in weight and stiffer than prior art aluminum plate containers.

Figure 3:
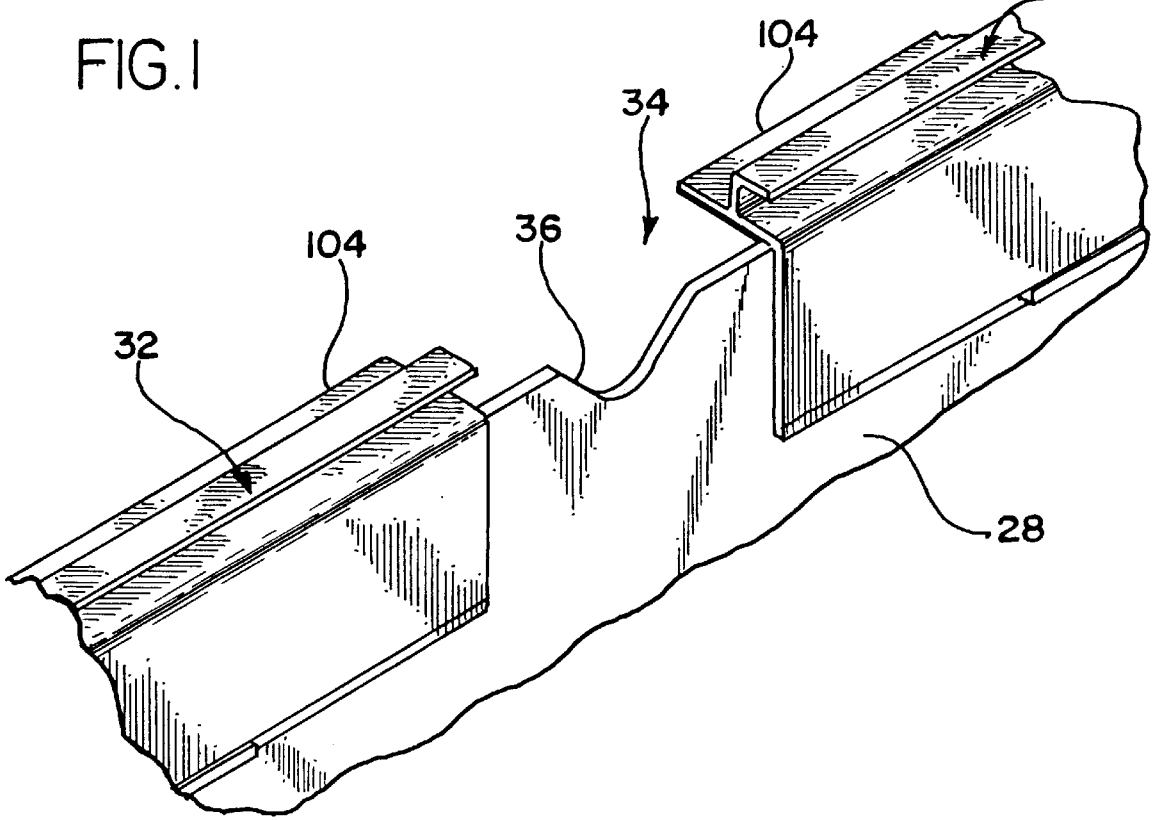
FIG. 3 is a perspective view of a portion of the side wall and a portion of a top rail.
Figure 2:
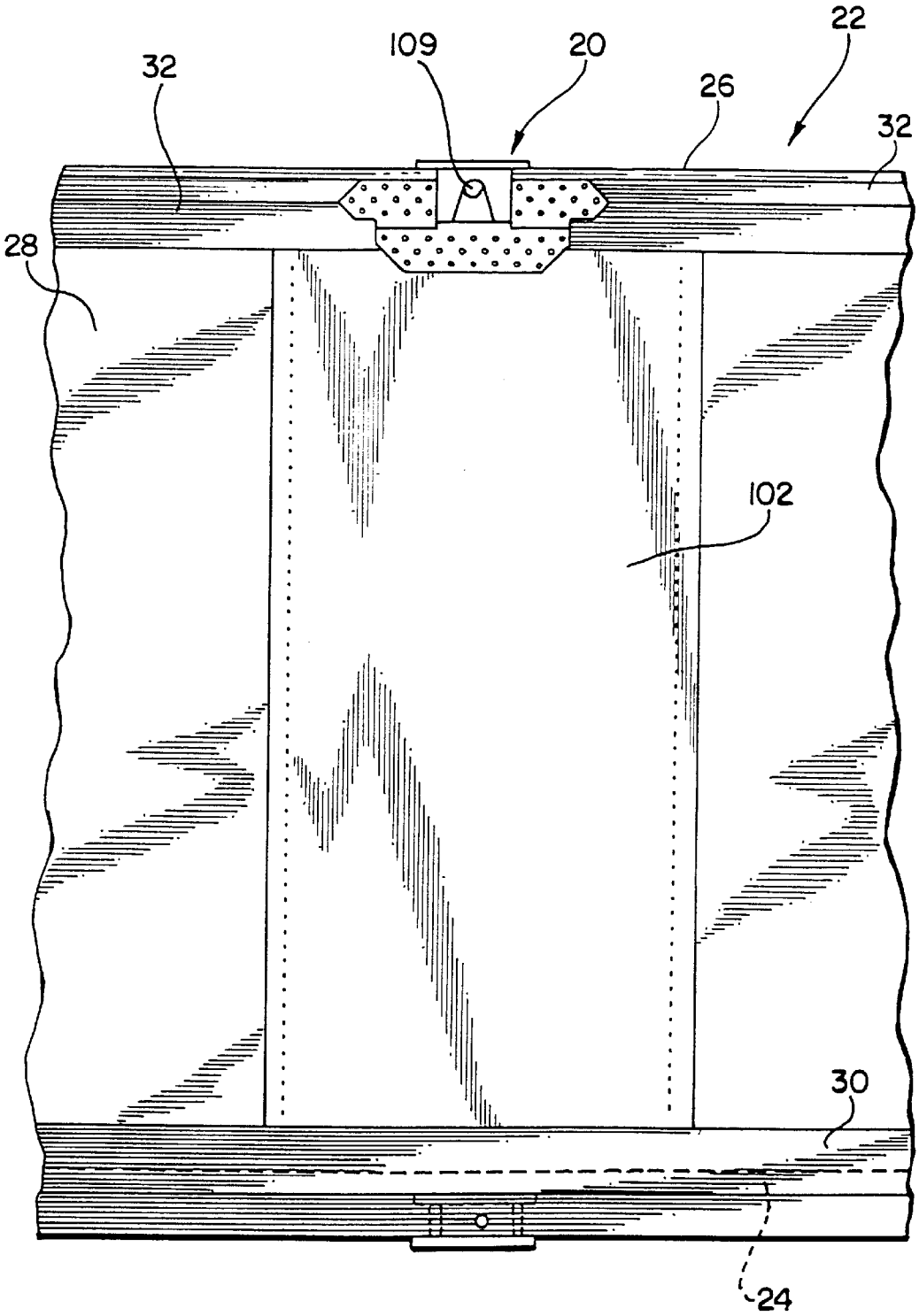
FIG. 2 is an enlarged, partial side view, with a portion of the container being shown in cross-section and showing the multi-component lifting assembly which incorporates the features of the invention.

At points which are approximately forty feet apart along each side wall 28 of the container 22, the top rail 32 is interrupted by a recess 34 and the top edge of the side wall 28 is provided with a generally U-shaped notch 36 at the center of the recess 34, see FIG. 3. It is at these points that the novel multi-component lifting assembly 20 of the present invention is provided. This provides for four-point lifting stability when the container 22 is lifted by an overhead crane (not shown).

Each multi-component lifting assembly 20 is identical in structure and as such, only the forward multi-component lifting assembly is described with the understanding that the rearward multi-component lifting assembly is identical.

Figure 4:
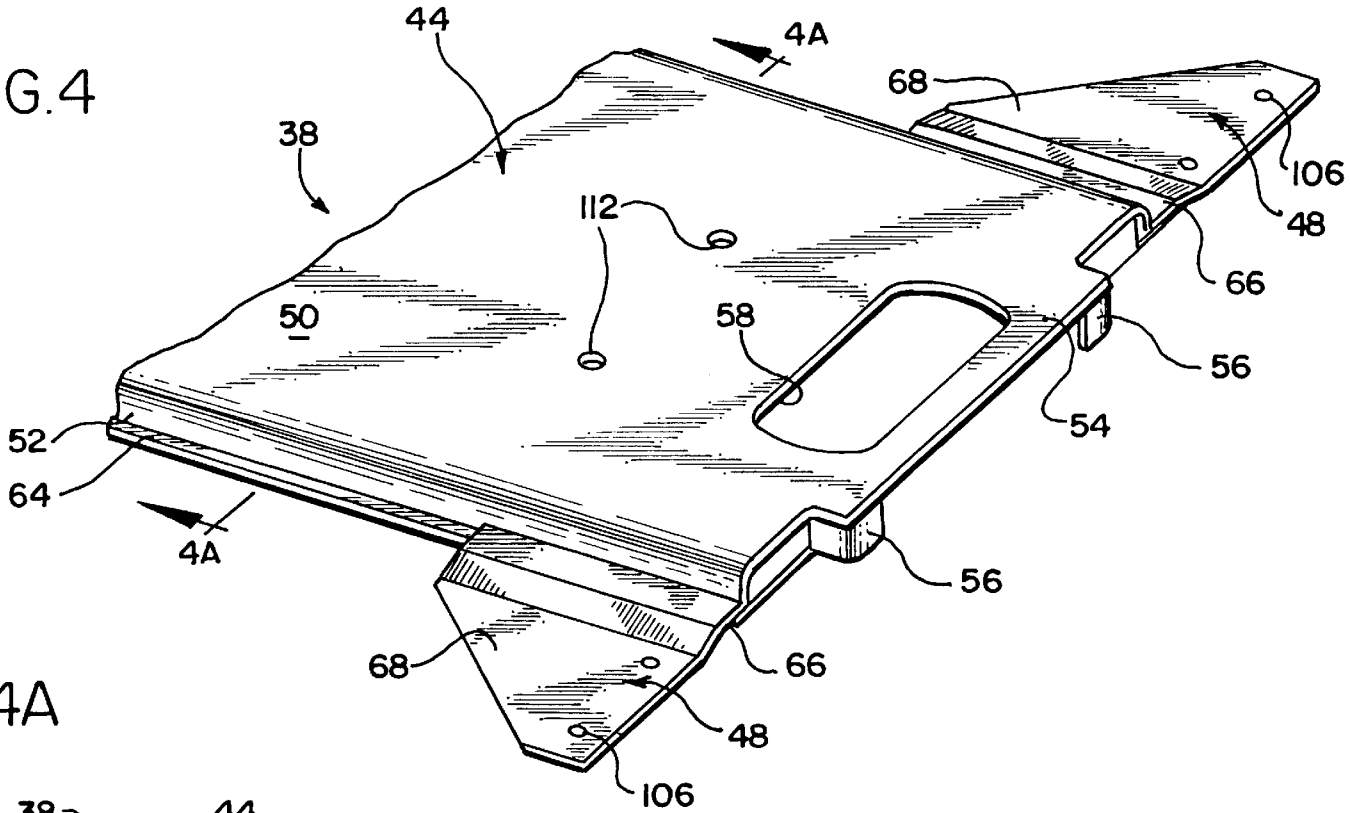
FIG. 4 is a perspective view of a portion of a stacking header which is a component of the multi-component lifting assembly.
Figure 4A:
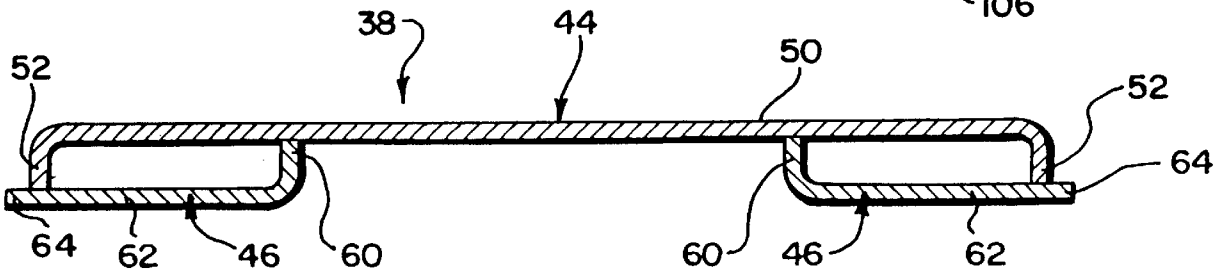
FIG. 4A is a cross-section view of FIG. 4 along line 4A—4A.
Figure 5:
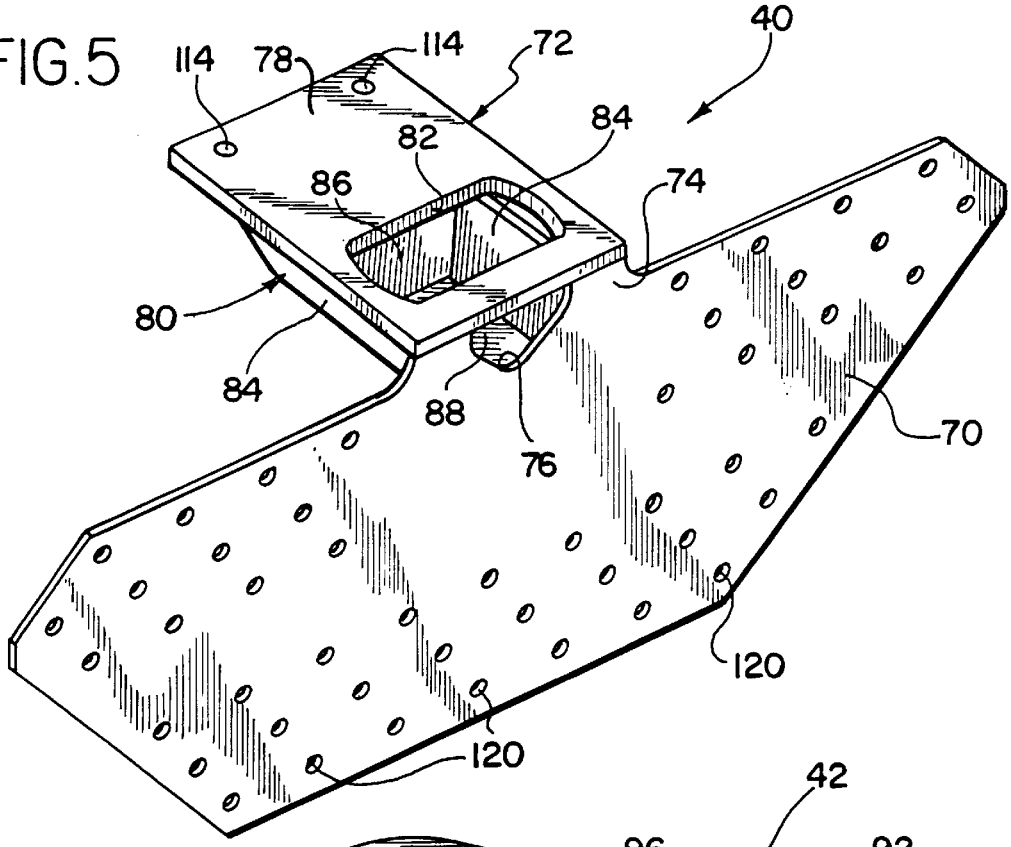
FIG. 5 is a perspective view of an inner cap which is a component of the multi-component lifting assembly.
Figure 6:
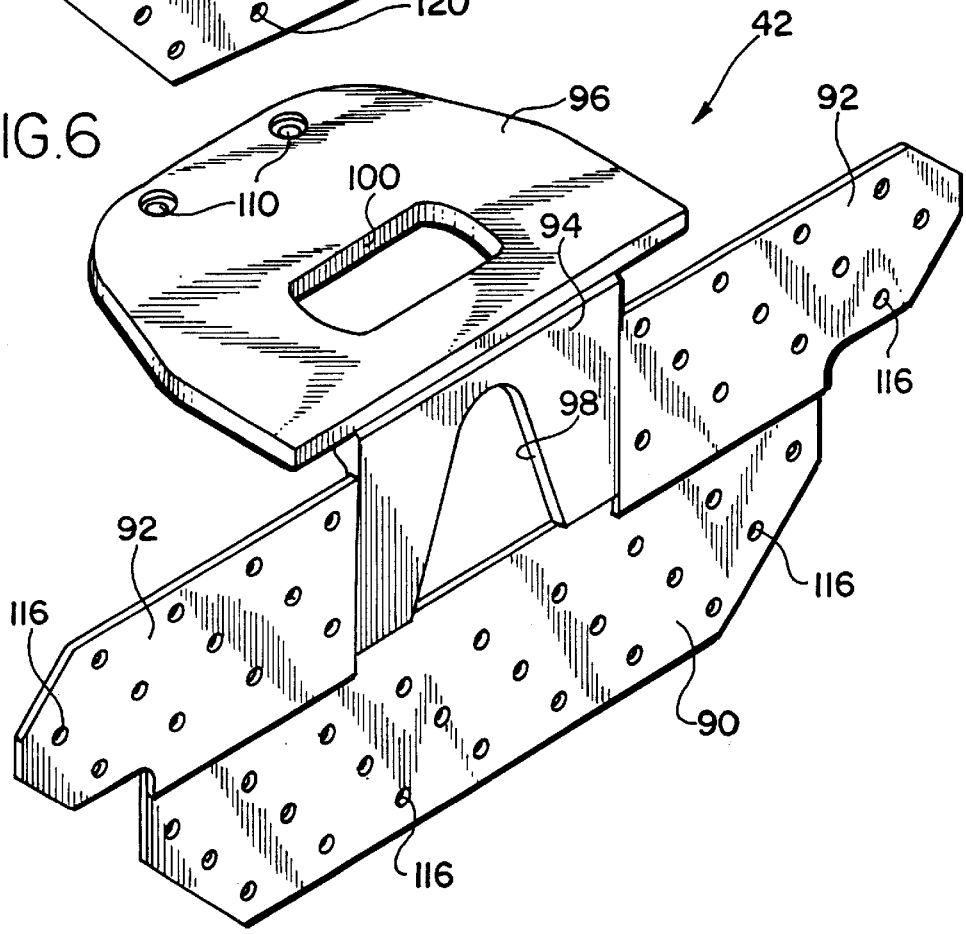
FIG. 6 is a perspective view of an outer cap which is a component of the multi-component lifting assembly.
Figure 7:
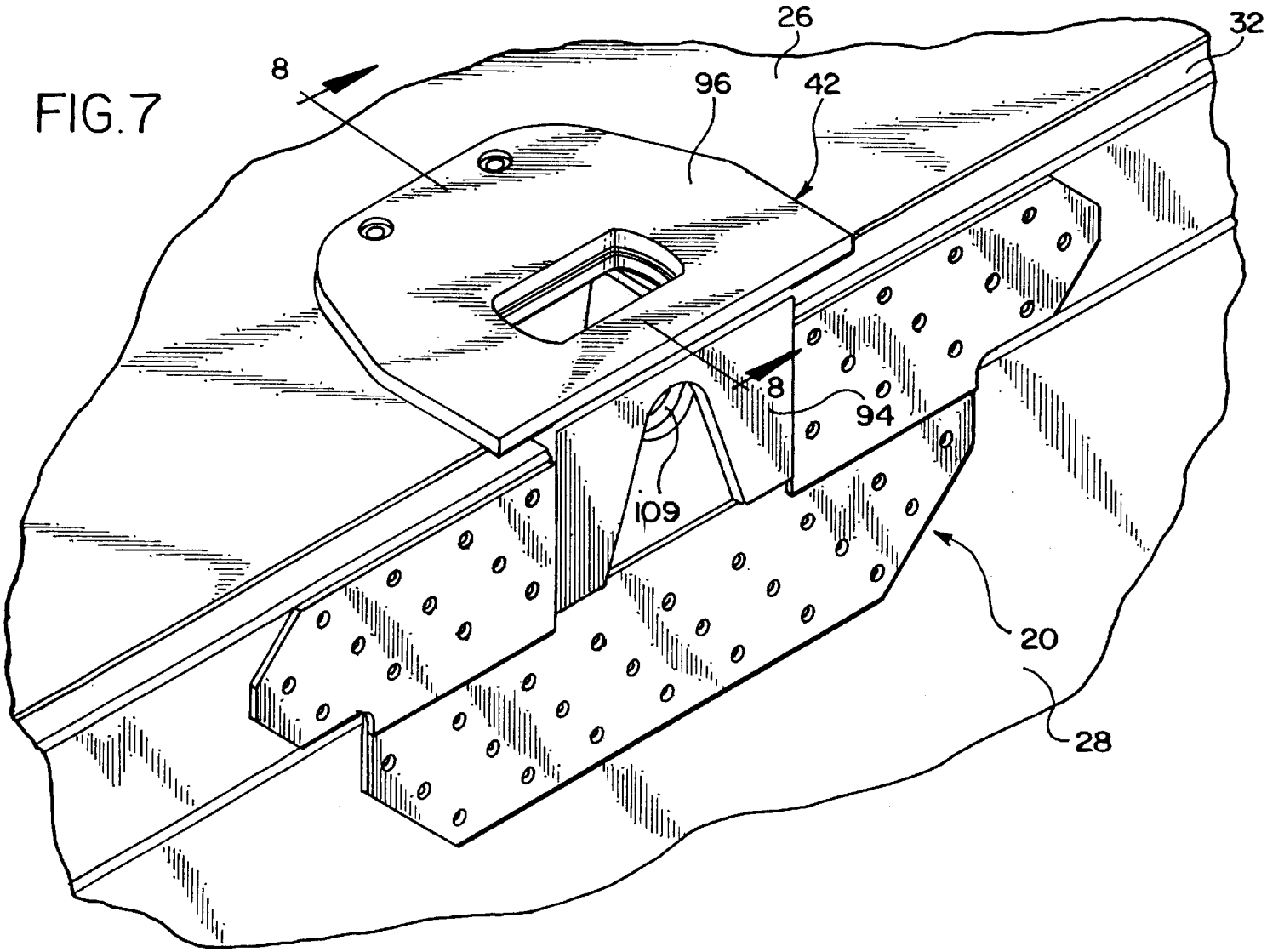
FIG. 7 is a perspective view of the multi-component lifting assembly assembled with the container.
Figure 8:
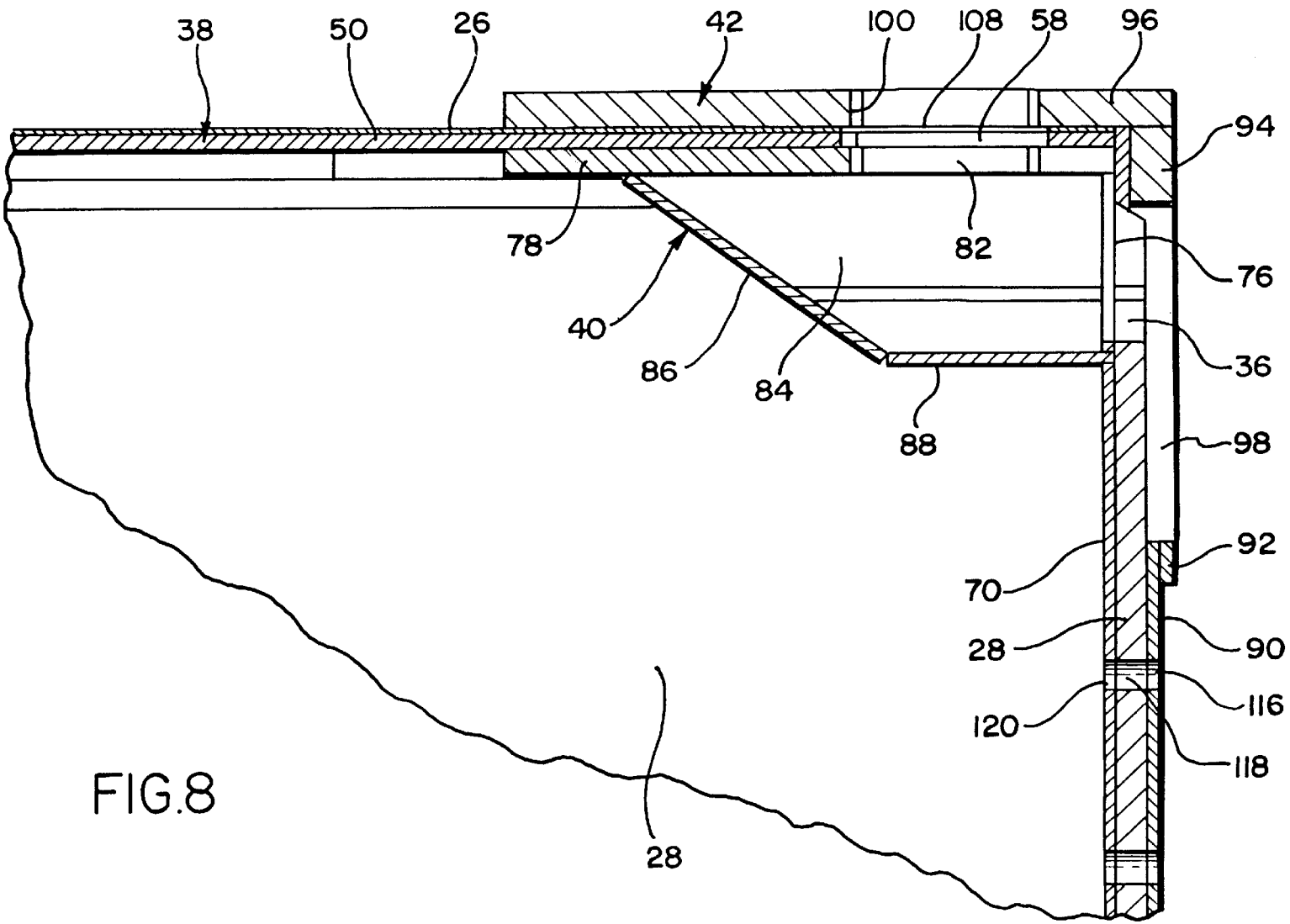
FIG. 8 is a cross-section view of FIG. 7 along line 8—8.

The multi-component lifting assembly 20 includes a stacking header 38, see FIGS. 4 and 4A, which extends across the width of the container 22, an inner cap 40, see FIG. 5, provided at each end of the stacking header 38, and an outer cap 42, see FIG. 6, provided at each end of the stacking header 38, with the side wall 28 and the roof sheet 26 being sandwiched between the inner cap 40 and the outer cap 42, see FIG. 8. Each inner cap 40 is identical in structure and as such, only one inner cap is described with the understanding that the other inner cap is identical. Each outer cap 42 is identical in structure and as such, only one outer cap is described with the understanding that the other outer cap is identical.

With reference to FIGS. 4 and 4A, the stacking header 38 is formed from a heavy duty metal which withstands the squeeze of 3500 pounds maximum when the container 22 is lifted by the overhead crane using side pins. The stacking header 38 includes an upper member 44, a pair of lower members 46 and a pair of wing members 48.

The upper member 44 is formed from an elongated horizontal plate 50 which extends across the width of the container and which has a vertical flange 52 extending downwardly from each side thereof. An extension portion 54, which has a length which is less than the remainder of the plate 50, is provided at each end of the plate 50. A pair of spacer flanges 56 extend downwardly from side edges of the extension portion 54 such that the inner edges of spacer flanges 56 are spaced apart from each other. An aperture 58 is provided through the opposite ends of the horizontal plate 50 at a position which is spaced from the respective ends of the horizontal plate 50 such that the aperture 58 does not extend through the extension portion 54.

Each lower member 46 is elongated such that it extends along the same length as the length of the upper member 44. Each lower member 46 includes a vertical leg 60 and a horizontal leg 62. The upper end of each vertical leg 60 is connected, such as by welding, to the underside of the plate 50 such that it does not interfere with the aperture 58 through the plate 50. As such, the vertical legs 60 of the lower members 46 are spaced apart from each other. The lower end of the respective flanges 52 are connected, such as by welding, to the upper surface of the horizontal leg 62 of the respective lower members 46 at a position which is spaced inwardly from the outer edges of the respective horizontal leg 62. An outer end portion 64 of each horizontal leg 62 extends outwardly from the flange 52.

A wing 48 is attached to an upper surface of each outer end portion 64 of the respective lower member 46 by suitable means, such as welding, and extends outwardly therefrom. The wing 48 includes a stepped portion 66, which is attached to the respective outer end portion 64, and an outer portion 68 which extends outwardly therefrom.

With reference to FIG. 5, the inner cap 40 is formed from metal and includes a vertical backing plate 70 and a horizontally arranged box portion 72. The backing plate 70 and the box portion 72 are joined together by suitable means, such as welding, at a top end of the backing plate 70 and at an outer end of the box portion 72.

The backing plate 70 has a length which is greater than the length of the box portion 72. An extension 74 is provided at the center of the upper end of the backing plate 70 and the box portion 72 is joined to the backing plate 70 along the top edge of the extension 74. A generally U-shaped cutout 76 is provided through the extension 74 and extends downwardly from the top edge thereof.

The box portion 72 includes an upper rectangularly-shaped plate 78 and a lower portion 80. The plate 78 has a rectangular aperture 82 provided therethrough proximate to, but spaced from, the outer edge of the plate 78. The longer dimension of the aperture 82 is parallel to the length of the backing plate 70 and the shorter dimension of the aperture 82 is perpendicular to the backing plate 70.

The lower portion 80 includes a pair of spaced apart side walls 84 and a rear wall 86 which extend downwardly from the underside of the upper plate 78, and a bottom wall 88 which is attached to the lower ends of the side walls 84 and the rear wall 86. The side walls 84 extend downwardly from the underside of the upper plate 78 and extend from the outer edge of the upper plate 78 toward the inner edge of the upper plate 78. The outer edges of the side walls 84 are connected to the rear side of the backing plate 70, such as by welding. The side walls 84 are generally provided on the opposite sides of the aperture 82 through the upper plate 78 and on the opposite sides of the cutout 76 through the extension 74 on the backing plate 70 such that the side walls 84 do not interfere with the aperture 82 and with the cutout 76. The rear wall 86 extends downwardly from the underside of the upper plate 78 and at an angle thereto. The rear wall 86 is connected to the inner edges of the side walls 84. The bottom wall 88 is generally parallel to the upper plate 78 and is connected to the bottom ends of the side walls 84 and the rear wall 86. The outer edge of the bottom wall 88 is connected to the rear side of the backing plate 70, such as by welding. The bottom wall 88 is positioned such that it is below the bottom end of the cutout 76 through the extension 74 so that the bottom wall 88 does not interfere with the cutout 76.

With reference to FIG. 6, the outer cap 42 includes a lower vertical connection plate 90, a pair of upper vertical connection plates 92, a pin attachment plate 94 and a horizontal connection plate 96. The outer cap 42 is formed from metal.

The upper end of the lower vertical connection plate 90 is attached to the lower end of each upper vertical connection plate 92 by suitable means, such as welding. The inner edges of the upper vertical connection plate 92 are spaced apart from each other such that a gap is provided therebetween.

The pin attachment plate 94 is mounted within the gap between the upper vertical connection plates 92 such that the opposite side edges of the pin attachment plate 94 are attached to the inner edge of the respective upper vertical connection plate 92 by suitable means, such as welding. The bottom edge of the pin attachment plate 94 is connected to the upper edge of the lower vertical connection plate 90. The upper edge of the pin attachment plate 94 is connected to the outer edge of the horizontal connection plate 96. The pin attachment plate 94 has an inverted generally U-shaped cutout 98 therethrough which extends upwardly from the bottom edge thereof.

The horizontal connection plate 96 extends inwardly from the top edge of the pin attachment plate 94. A rectangular aperture 100 is provided through the horizontal connection plate 96 at a position which is proximate to, but spaced from, the outer edge of the horizontal connection plate 96. The longer dimension of the aperture 100 is parallel to the length of the pin attachment plate 94 and the shorter dimension of the aperture 100 is perpendicular to the pin attachment plate 94.

A pair of thickened wall portions 102, see FIG. 1, which are aligned with the respective multi-component lifting assemblies 20 are provided on each side wall 28. Such thickened wall portions 102 are disclosed in co-pending U.S. patent application Ser. No. 09/245,215, filed Feb. 5, 1999 now abandoned, which is commonly owned herewith and which disclosure is herein incorporated by reference. The center point of each thickened wall portion 102 on the respective side walls 28 is approximately forty feet apart from each other along the length of the container 22. Preferably, the center point of each thickened wall portion 102 on the respective side wall 28 is 39'3⅞" apart from each other along the length of the container 22. Preferably, each thickened wall portion 102 is approximately forty six inches in length relative to the length of the container 22, but can be longer or shorter. The thickened wall portions 102 increase the thickness of the respective side walls 28 at those points by approximately 0.240" to 0.5", thereby providing an overall thickness of the side walls 28 at those points of approximately 0.48" to 0.75". It has been found that a composite plate thickness of 0.320" with a thickness of 0.625" to 0.640" at the thickened portions 102 has performed well. The thickened wall portions 102 are provided at the stacking and lifting locations of the container 22 to increase stiffness and to provide strength to the container 22 in compression loading. The thickened portions 102 which are in the fore end of the container 22 provide for compression loading at the front of the container 22 and thickened portions 102 which are in the aft end of the container 22 provide for compression loading at the rear of the container 22.

The thickened wall portion 102 can be provided by a doubler plate which is secured to the exterior of the side wall 28 by suitable means, such as rivets. The doubler plate may be a metal plate or a composite plate like the composite plates used to form the side walls 28. Alternatively, the thickened wall portion 102 can be provided by increasing the thickness of the core member at the lifting and compression points of the side walls 28 relative to the remainder of the side wall 28. The outer skin of the composite plate of the side wall 28 bulges outwardly around the increased thickness of the core member. The combination of the doubler plate and the plate used to form the side wall 28, or the provision of the thickened plate, provides an overall thickness of approximately 0.48" to 0.75" at the compression point based on a 2G dynamic load.

To assemble the container 22 with the novel multi-component lifting assembly 20 of the present invention, the front frame, the rear frame, the floor 24 and the opposite side walls 28 are assembled and secured to each other in a conventional fashion to form a container box. The roof sheet 26 is not yet attached thereto.

The forward and rearward stacking headers 38 are then set into the top of the container box at the same time as the roof bows are set, and prior to the roof sheet 26 being attached thereto. The container box is held square by suitable means in three-axes and the forward and rearward stacking headers 38 are installed square to the container box. The extensions 54 on the ends of each stacking header 38 sit, within the respective recesses 34 in the top rails 32. At this point, an aperture is defined between the notch 36 in the respective side wall 28 and the underside of the extension portion 54 of the stacking header 38. The wings 48 on each end of each stacking header 38 sit on top of a horizontal leg 104 of the top rail 32 on either side of the recess 34 and are secured thereto by suitable means, such as fasteners which extend through apertures 106 in the wings 48. This secures the respective stacking header 38 to the container box.

Next, the roof sheet 26 is laid in one piece on top of the stacking headers 38 and the roof bows and is secured thereto. The roof sheet 26 has rectangular apertures 108 therethrough which align with the aperture 58 through the stacking header 38.

Thereafter, the inner caps 40 are held on the inside of the container box and against the underside of the respective ends of the respective stacking headers 38. The aperture 82 in the upper plate 78 of the inner cap 40 aligns with aligned apertures 58, 108. The upper plate 78 of the respective inner cap 40 sits between the vertical legs 60 of the lower members 46 of the respective stacking header 38.

Finally, the outer cap 42 is installed on the outside of the container box. The aperture 100 through the horizontal connection plate 96 aligns with the apertures 108, 58, 82 through the roof sheet 26, through the stacking header 38 and in the inner cap 40. The inverted generally U-shaped cutout 98 in the pin attachment plate 94 aligns with the notch 36 in the upper end of the side wall 28 and with the U-shaped cutout 76 through the backing plate 70 of the inner cap 40 so that a generally round hole 109 is defined. The outer cap 42, the roof sheet 26, the stacking header 38 and the inner cap 40 are secured together on the top of the container 22 by suitable means, such as fasteners (not shown) which extend through aligned apertures 110, 112, 114 provided through the horizontal connection plate 96 of the upper cap 42, through the roof sheet 26 (these apertures are not shown), through the plate 50 of the stacking header 38, and through the upper plate 78 of the inner cap 40. The outer cap 42, the side wall 28 and the inner cap 40 are secured together on the side of the container 22 by suitable means, such as fasteners (not shown) which extend through aligned apertures 116, 118, 120 provided in the lower and upper connection plates 90, 92 of the outer cap 42, the side wall 28 and the bearing plate 70 of the inner cap 40. The connection plates 90, 92 of the outer cap 42 and the bearing plate 70 of the inner cap 40 place the fasteners in double shear.

Because the front and rear frames and the side walls 28 of the container 22 are assembled and secured to each other in a conventional fashion to form a container box prior to attachment of the multi-component lifting assembly 20 of the present invention and the roof sheet 26, almost the entire container 22 can be built prior to the addition of these components.

In addition, the roof sheet 26 is continuous, with the exception of the apertures described herein therethrough, and the side walls 28 are continuous. This substantially minimizes the possibility of cracking of the roof sheet 26 and of the side walls 28 as a result of fatigue and therefore minimizes the possibility of leaks developing.

To lift the container 22 using side lifting pins (not shown), such side lifting pins and mechanism for lifting being conventional, the side lifting pins are inserted through the respective holes 109 defined by the alignment of the inverted generally U-shaped cutout 98 in the pin attachment plate 94, the notch 36 in the upper end of the side wall 28 and the U-shaped cutout 76 through the backing plate 70 of the inner cap 40. The side lifting pins pass through the plane defined by the side wall 28 of the container 22. The inverted U-shape of the cutout 98 in the pin attachment plate 94 of the outer cap 42 provides a guide for the side lifting pin such that if the side lifting pin is not precisely on target when engaged against the container 22, the side lifting pin will be guided into the hole 109 as the side lifting pin is moved upwardly along the side of the container 22.

To lift the container 22 by top lifting, a bayonet (not shown) is used, such bayonet and mechanism for lifting being conventional. Each bayonet is inserted through the respective aligned apertures 100, 108, 58, 82 through the horizontal connection plate 96 of the outer cap 42, through the roof sheet 26, through the plat 50 of the stacking header 38 and upper plate 78 of the inner cap 40. Each bayonet is turned so that it grasps the underside of the upper plate 78 of the inner cap 40.

While the pair of inner caps 40 and the forward stacking header 38 and the pair of inner caps 40 and the rearward stacking header 38 are described as two separate components, it is to be understood that the inner caps 40 can be combined with the respective stacking header 38 to be formed as a single component.

The multi-component lifting assembly 20 of the present invention reduces the amount of interior space used compared to prior art lifting assemblies. The stacking header 38 extends into the interior of the container 22 the same distance the roof bows extend into the interior of the container 22. The only portion of the multi-component lifting assembly 20 which takes up space within the container 22 is the lower portion 80 of the inner cap 40.

Figure 9:
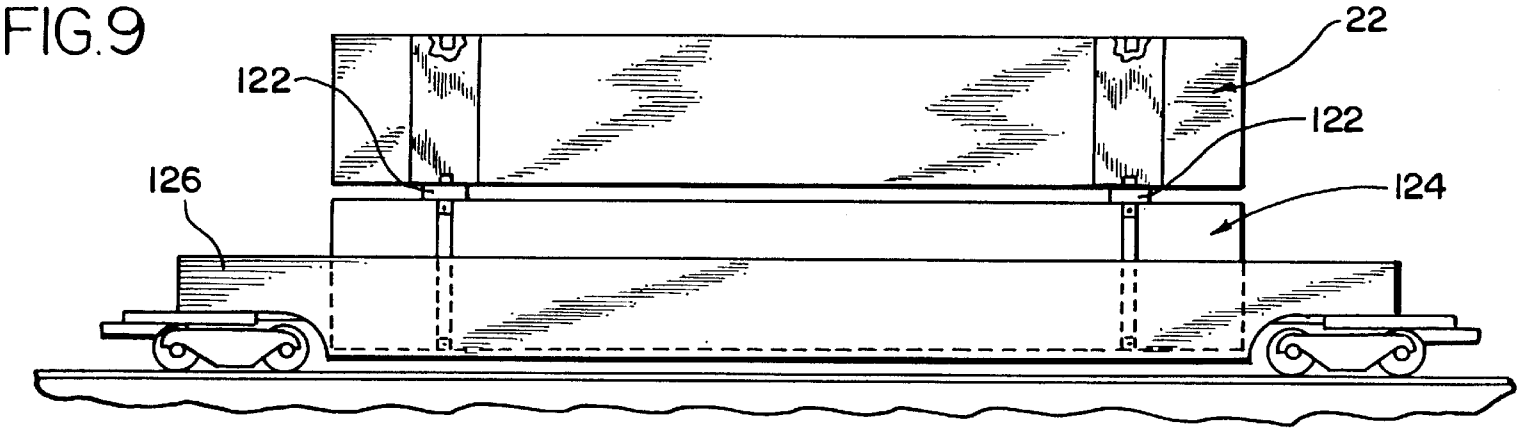
FIGS. 9 and 10 are side elevational views of the container which incorporates the features of the present invention stacked with a prior art domestic container.

The container 22 having the novel multi-component lifting assembly 20 of the present invention thereon can be stacked on top of a prior art fifty three foot domestic container, on top of a prior art forty-eight foot domestic container, on top of a prior art forty-five foot domestic container, or on top of a prior art forty foot ISO container and connected with an interbox connector 122 which is common in the industry. FIG. 9 shows the present container 22 stacked on top of a prior art fifty three foot domestic container 124 and loaded into a well of rail car 126 (the distance between the containers 22, 124 being exaggerated for purposes of illustration). The interbox connector 122 has a bayonet which sticks down into and connects with a top aperture in the bottom container and a bayonet which sticks up into and connects with a bottom aperture into the present container 22. The bayonets are rotated to lock the containers together. Each of the prior art fifty-three foot domestic container, the prior art forty-eight foot domestic container, the prior art forty-five foot domestic container, and the prior art forty foot ISO container includes prior art steel tube posts therein that can take the compression load from the top casting down through the containers.

Figure 10:
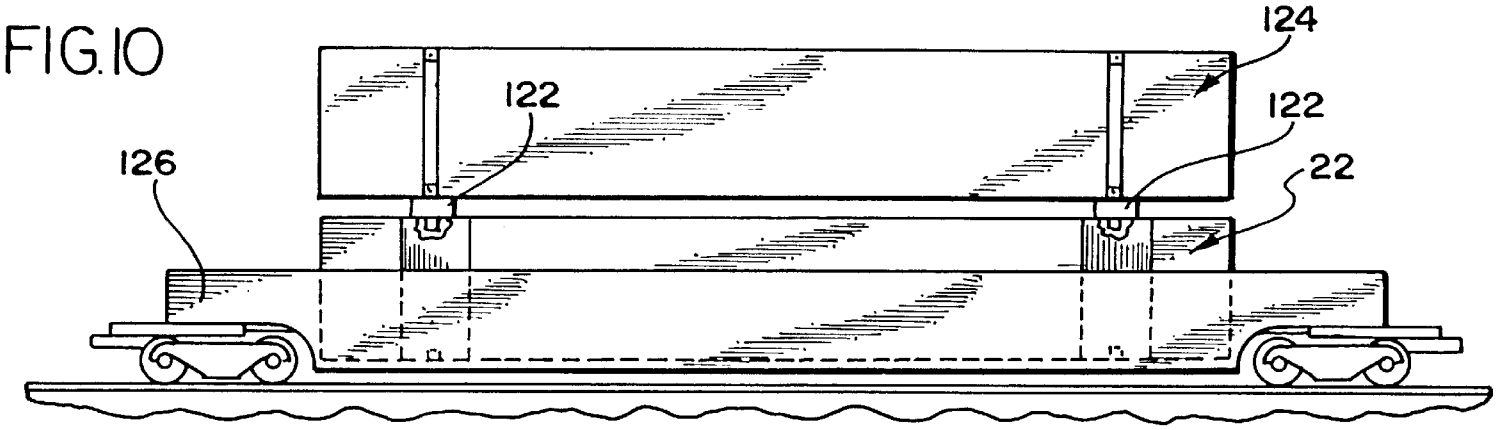

The container 22 having the novel multi-component lifting assembly of the present invention thereon can be stacked under a prior art fifty-three foot domestic container, under a prior art forty-eight foot domestic container, under a prior art forty-five foot ISO container, or under a prior art forty foot ISO container and locked together with the interbox connector 122. FIG. 10 shows the present container 22 stacked under a prior art fifty three foot domestic container 124 and loaded into a well of rail car 126 (the distance between the containers 22, 124 being exaggerated for purposes of illustration). Even though the container 22 which incorporates the multi-component lifting assembly 20 of the present invention does not have steel tube posts, the container 22 can take the compression load from the container stacked thereon.

In each of these combinations, the thickened wall portions 102 provided at the stacking and lifting locations of the container 22 increase stiffness and provide strength to the container 22 in compression loading.

While a preferred embodiment of the present invention is shown and described, it is envisioned that those skilled in the art may devise various modifications of the present invention without departing from the spirit and scope of the appended claims.

The invention claimed is:

1. A container for carrying cargo comprising:

a floor; opposite side walls extending upwardly therefrom; a roof sheet attached to upper ends of said side walls, said roof sheet having opposite side edges; a first lifting assembly attached to one said side wall and to one said side edge of said roof sheet; and a second lifting assembly attached to the other said side wall and to the other said side edge of said roof sheet, each said lifting assembly comprising a first component provided on an interior of said container and a second component provided on an exterior of said container, said respective roof sheet and said respective side wall being sandwiched between said first and second components.

2. A container as defined in claim 1, further including aligned apertures provided through each said first component, said respective edges of said roof sheet and each said second component such that an outside member can be inserted into said aligned apertures and said container can be lifted thereby.

3. A container as defined in claim 2, further including an aperture provided through each said first component, a notch provided in a top of said respective side wall and an aperture provided through each said second component, said respective apertures and said respective notch being aligned with each other such that an outside member can be inserted into said respective aligned apertures and said notch and said container can be lifted thereby.

4. A container as defined in claim 3, wherein said first component includes a pocket which seals said aligned apertures and notch from said interior of said container.

5. A container as defined in claim 3, wherein said aperture through each said second component is an inverted, generally U-shape.

6. A container as defined in claim 2, wherein fastener apertures are provided through said roof sheet for attaching fastener members through each said first component, said respective side edges of said roof sheet and each said second component, said roof sheet being continuous except for said aligned apertures and said fastener apertures.

7. A container as defined in claim 2, wherein said first component includes a pocket which seals said aligned apertures from said interior of said container.

8. A container as defined in claim 1, further including an aperture provided through each said first component, a notch provided in a top of said respective side wall and an aperture provided through each said second component, said respective apertures and said respective notch being aligned with each other such that an outside member can be inserted into said respective aligned apertures and said notch and said container can be lifted thereby.

9. A container as defined in claim 8, wherein said first component includes a pocket which seals said aligned apertures and notch from said interior of said container.

10. A container as defined in claim 8, wherein said aperture through each said second component is an inverted, generally U-shape.

11. A container as defined in claim 1, further including aligned apertures provided through each said first component and each said second component through a top of said container such that an outside member can be inserted into said aligned apertures and said container can be lifted thereby.

12. A container as defined in claim 1, further including aligned apertures provided through each said first component and each said second component on a side of said container such that an outside member can be inserted into said aligned apertures and said container can be lifted thereby.

13. A container as defined in claim 12, wherein said aperture through each said second component is an inverted, generally U-shape.

14. A container as defined in claim 1, further including a header provided on said interior of said container between said first component of said first lifting assembly and said first component of said second lifting assembly.

15. A container as defined in claim 1, wherein said container can be stacked on top of or under a like container.

16. A container as defined in claim 1, wherein said first and second lifting assemblies form a first set, are aligned with each other on opposite sides of said container and are provided on said container at a predetermined position along the length thereof, and a second set of like first and second lifting assemblies are provided on said container at a second predetermined position along the length thereof which is spaced from said position of said first set, said sets of like first and second lifting assemblies being aligned with each other on said opposite sides of said container.

17. A container for carrying cargo comprising:

a floor; opposite side walls extending upwardly therefrom; a roof sheet attached to upper ends of said side walls, said roof sheet having opposite side edges; a first lifting assembly attached to one said side wall and to one said side edge of said roof sheet; and a second lifting assembly attached to the other said side wall and to the other said side edge of said roof sheet, each said lifting assembly comprising a first component provided on an interior of said container and a second component provided on an exterior of said container, said roof sheet and said respective side wall being sandwiched between said first and second components of each said lifting assembly, a first set of aligned apertures provided through said first component of said first lifting assembly, one of said side edges of said roof sheet and said second component of said first lifting assembly, and a second set of aligned apertures provided through said first component of said second lifting assembly, the other one of said side edges of said roof sheet and said second component of said second lifting assembly such that a first outside member can be inserted into said first set of aligned apertures and a second outside member can be inserted into said second set of aligned apertures and said container can be lifted thereby, and a third set of aligned apertures provided through said first component of said first lifting assembly, one of said side walls and said second component of said first lifting assembly and a fourth set of aligned apertures provided through said first component of said second lifting assembly, the other of said side walls and said second component of said second lifting assembly such that a third outside member can be inserted into said third set of aligned apertures and a fourth outside member can be inserted into said fourth set of aligned apertures and said container can be lifted thereby.

18. A container as defined in claim 17, wherein said first and second lifting assemblies form a first set, are aligned with each other on opposite sides of said container and are provided on said container at a predetermined position along the length thereof, and a second set of like first and second lifting assemblies are provided on said container at a second predetermined position along the length thereof which is spaced from said position of said first set, said sets of like first and second lifting assemblies being aligned with each other on said opposite sides of said container.

19. A pair of stackable containers, each container capable of carrying cargo, comprising:

a first container;

a second container comprising a floor; first and second opposite side walls extending upwardly therefrom; a roof sheet attached to upper ends of said side walls, said roof sheet having opposite side edges; a first lifting assembly attached to said first side wall and to one said side edge of said roof sheet, said first side wall having a thickened portion aligned with said first lifting assembly; and a second lifting assembly attached to said second side wall and to the other said side edge of said roof sheet, said second side wall having a thickened portion aligned with said second lifting assembly, each said lifting assembly comprising a first component provided on an interior of said container and a second component provided on an exterior of said container, said respective roof sheet and said respective side wall being sandwiched between said first and second components;

an interbox connector for connecting said first container and said second container together such that said first container is stacked upon said second container.

20. A pair of stackable containers, each container capable of carrying cargo, comprising:

a first container;

a second container comprising a floor; first and second opposite side walls extending upwardly therefrom; a roof sheet attached to upper ends of said side walls, said roof sheet having opposite side edges; a first lifting assembly attached to said first side wall and to one said side edge of said roof sheet, said first side wall having a thickened portion aligned with said first lifting assembly; and a second lifting assembly attached to said second side wall and to the other said side edge of said roof sheet, said second side wall having a thickened portion aligned with said second lifting assembly, each said lifting assembly comprising a first component provided on an interior of said container and a second component provided on an exterior of said container, said respective roof sheet and said respective side wall being sandwiched between said first and second components;

an interbox connector for connecting said first container and said second container together such that said first container is stacked under said second container.

* * * * *